US009303322B2

(12) United States Patent
Victor et al.

(10) Patent No.: US 9,303,322 B2
(45) Date of Patent: Apr. 5, 2016

(54) METALLIC ARTICLES WITH HYDROPHOBIC SURFACES

(75) Inventors: Jared J. Victor, Toronto (CA); Uwe Erb, Fraserville (CA); Klaus Tomantschger, Mississauga (CA); Nandakumar Nagarajan, Burlington (CA); Diana Facchini, Toronto (CA)

(73) Assignee: Integran Technologies Inc., Toronto (CA)

( * ) Notice: Subject to any disclaimer, the term of this patent is extended or adjusted under 35 U.S.C. 154(b) by 758 days.

(21) Appl. No.: 12/785,650

(22) Filed: May 24, 2010

(65) Prior Publication Data

US 2011/0287223 A1 Nov. 24, 2011

(51) Int. Cl.

| | |
|---|---|
| ***B23P 9/00*** | (2006.01) |
| ***C23C 30/00*** | (2006.01) |
| ***C25D 5/16*** | (2006.01) |
| ***C25D 1/02*** | (2006.01) |
| ***C25D 1/10*** | (2006.01) |
| ***C25D 5/48*** | (2006.01) |
| ***C25D 15/00*** | (2006.01) |
| ***C25D 1/00*** | (2006.01) |
| *C23C 18/16* | (2006.01) |

(52) U.S. Cl.

CPC ..... *C23C 30/00* (2013.01); *C25D 1/006* (2013.01); *C25D 1/02* (2013.01); *C25D 1/10* (2013.01); *C25D 5/16* (2013.01); *C25D 5/48* (2013.01); *C25D 15/00* (2013.01); *C23C 18/1653* (2013.01); *Y10T 428/24355* (2015.01); *Y10T 428/24372* (2015.01); *Y10T 428/24405* (2015.01); *Y10T 428/24413* (2015.01); *Y10T 428/24421* (2015.01)

(58) Field of Classification Search

USPC ..... 428/548, 553, 565, 615, 457, 141, 143, 428/148; 473/566, 567, 316–326, 457, 519, 473/520, 564; 427/230; 72/53

See application file for complete search history.

(56) References Cited

U.S. PATENT DOCUMENTS

| | | | |
|---|---|---|---|
| 3,303,111 | A | 2/1967 | Peach |
| 3,354,022 | A | 11/1967 | Dettre et al. |
| 4,168,183 | A | 9/1979 | Greenfield |
| 4,529,668 | A | 7/1985 | Croopnick et al. |
| 5,032,464 | A | 7/1991 | Lichtenberger |
| 5,288,344 | A | 2/1994 | Peker et al. |

(Continued)

FOREIGN PATENT DOCUMENTS

| | | |
|---|---|---|
| CN | 101665968 | 3/2010 |
| DE | 10108893 | 10/2002 |

(Continued)

OTHER PUBLICATIONS

Shafiei, Mehdi and Alpas, Ahmet; "Nanocrystalline Nickel Films with Lotus Leaf Texture for Syperhydrophobic and Low Friction Surfaces" Applied Surface Science 256 (2009) 710-719.*

(Continued)

*Primary Examiner* — Daniel J Schleis

(74) *Attorney, Agent, or Firm* — Rankin, Hill & Clark LLP

(57) ABSTRACT

Articles containing fine-grained and/or amorphous metallic coatings/layers on at least part of their exposed surfaces are imprinted with surface structures to raise the contact angle for water in the imprinted areas at room temperature by equal to or greater than 10°, when compared to the flat and smooth metallic material surface of the same composition.

21 Claims, 3 Drawing Sheets

(56) References Cited

U.S. PATENT DOCUMENTS

| | | | | |
|---|---|---|---|---|
| 5,302,414 | A | 4/1994 | Alkhimov et al. | |
| 5,352,266 | A | 10/1994 | Erb et al. | |
| 5,389,226 | A | 2/1995 | Scruggs et al. | |
| 5,433,797 | A | 7/1995 | Erb et al. | |
| 5,620,537 | A | 4/1997 | Bampton | |
| 5,649,994 | A | 7/1997 | Holko | |
| 5,753,251 | A | 5/1998 | Burrel | |
| 5,783,371 | A | 7/1998 | Bifano | |
| 5,863,410 | A | 1/1999 | Yates | |
| 5,872,074 | A | 2/1999 | Schulz et al. | |
| 6,660,363 | B1 | 12/2003 | Barthlott | |
| 6,764,745 | B1 | 7/2004 | Karasawa et al. | |
| 6,872,441 | B2 | 3/2005 | Baumann et al. | |
| 6,895,795 | B1 | 5/2005 | Chaudhury et al. | |
| 7,575,040 | B2 | 8/2009 | Johnson | |
| 7,803,072 | B2 | 9/2010 | Palumbo | |
| 2003/0187170 | A1 | 10/2003 | Burmeister | |
| 2003/0234181 | A1 | 12/2003 | Palumbo | |
| 2005/0003146 | A1 | 1/2005 | Spath | |
| 2005/0205425 | A1 | 9/2005 | Palumbo et al. | |
| 2006/0135281 | A1* | 6/2006 | Palumbo et al. | 473/316 |
| 2007/0031639 | A1* | 2/2007 | Hsu et al. | 428/141 |
| 2008/0217180 | A1* | 9/2008 | Doye et al. | 205/50 |
| 2009/0011222 | A1 | 1/2009 | Xiu et al. | |
| 2009/0159451 | A1 | 6/2009 | Tomantschger et al. | |
| 2009/0246473 | A1 | 10/2009 | Lee et al. | |
| 2009/0317590 | A1 | 12/2009 | Hwang et al. | |

FOREIGN PATENT DOCUMENTS

| | | |
|---|---|---|
| DE | 10228323 | 1/2004 |
| EP | 2045368 | 4/2009 |
| KR | 100845744 | 7/2008 |
| WO | 2008/100583 A1 | 8/2008 |

OTHER PUBLICATIONS

Zhou, Yali, et al.; "Superhydrophobic Surface Created by the Silver Mirror Reaction and its Drag-Reduction Effect on Water;" J. Mater. Chem., 2009, 19, 3301-3306.*

F. Mueller, "Pulse Plating & Other Myths", Plating & Surface Finishing, pp. 54-55, Apr. 2000.

D. Gabe et. al., "Protective Layered Electrodeposits", Electrochemica Acta, vol. 39, No. 8/9, pp. 1115-1121, 1994.

S.J. Bull et. al., "Multilayer Coatings for Improved Performance", Surface & Coating Technology 78 (1996) 173-184.

D. Facchini, J. L McCrea, F. González, K. Tomantschger, and G. Palumbo, "Small Crystals, Big Benefits: Nanotech cobalt alloy coatings offer hard chrome alternative", Product Finishing, 73, 7, p. 14-18, Apr. 2009.

D. Facchini, J. L McCrea, F. González, G. Palumbo, K. Tomantschger and U. Erb, "Nanostructured Metals and Alloys—Electrodeposited Nanostructured Cobalt Phosphorus Coatings as a Hard Chrome Alternative for Functional Applications," In: Jahrbuch Oberflächentechnik 64 2008: pp. 34-45.

B. Stein, A Practical Guide to Understanding, Measuring and Controlling Stress in Electroformed Metals, AESF Electroforming Symposium, Mar. 27-29, 1996, 1-6, Las Vegas, NV, USA.

Palumbo, G.; González, F.; Tomantschger, K.; Erb, U.; Aust, K.T. "Nanotechnology opportunities for electroplating industries" Plating and Surface Finishing, v 90, n 2, p. 36-45, Feb. 2003.

Kim, Simon H.; Erb, U.; Aust, K.T.; Gonzalez, F.; Palumbo, G., "The corrosion behavior of nanocrystalline electrodeposits" Plating and Surface Finishing, v 91, n 5, p. 68-70, May 2004.

Gonzalez, F. McCrea, J. Palumbo, G. Erb, U., "Nanostructured Electrodeposited Cobalt: An Alternative to Hard Chromium", Bulletin—Cercle D Etudes Des Metaux Saint Etienne, 2004, vol. 17; Issu 9, pp. 27.

Karimpoor, A.A.; Erb, U.; Aust, K.T.; Palumbo, G. "High strength nanocrystalline cobalt with high tensile ductility" Scripta Materialia, v 49, n 7, p. 651-6, Oct. 2003.

Karimpoor, A.A.; Erb, U.; Aust, K.T.; Wang, Z.; Palumbo, G "Tensile properties of bulk nanocrystalline hexagonal cobalt electrodeposits" Materials Science Forum, v 386-388, p. 415-20, 2002.

Kim, S.H.; Aust, K.T.; Erb, U.; Gonzalez, F.; Palumbo, G "A comparison of the corrosion behaviour of polycrystalline and nanocrystalline cobalt" Scripta Materialia, v 48, n 9, p. 1379-84, May 2003.

Hibbard, G.; Aust, K.T.; Palumbo, G.; Erb, U. "Thermal stability of electrodeposited nanocrystalline cobalt" Scripta Materialia, v 44, n 3, p. 513-18, Mar. 16, 2001.

Osmola, D.; Renaud, E.; Erb, U.; Wong, L.; Palumbo, G.; Aust, K.T. "Synthesis of nanocrystalline Co-W alloys" Materials Research Society Symposium Proceedings, v 286, p. 191-196, 1992.

Hibbard, G.D.; Palumbo, G.; Aust, K.T.; Erb, U. "Nanoscale combined reactions: non-equilibrium α-Co formation in nanocrystalline & epsi;-Co by abnormal grain growth" Philosophical Magazine, v 86, n 2, p. 125-39, Jan. 11, 2006.

Szpunar, Barbara; Aus, Martin; Cheung, Cedric; Erb, Uwe; Palumbo, Gino; Szpunar, Jerzy A "Magnetism in nanostructured Ni—P and Co—W alloys" Journal of Magnetism and Magnetic Materials, v 187, n 3, p. 325-336, Sep. 1, 1998.

Hibbard, G.D.; Aust, K.T.; Erb, U. "The effect of starting nanostructure on the thermal stability of electrodeposited nanocrystalline Co" Acta Materialia, v 54, n 9, p. 2501-10, May 2006.

Karimpoor, A.A.; Erb, U. "Mechanical properties of nanocrystalline cobalt" Physica Status Solidi A, v 203, n 6, p. 1265-70, May 2006.

Karimpoor, A.A.; Aust, K.T.; Erb, U. "Charpy impact energy of nanocrystalline and polycrystalline cobalt" Scripta Materialia, v 56, n 3, p. 201-4, Feb. 2007.

Hibbard, G.D.; Aust, K.T.; Erb, U. "Thermal stability of electrodeposited nanocrystalline Ni—Co alloys" Materials Science and Engineering A, v 433, n 1-2, p. 195-202, Oct. 15, 2006.

Mohammadreza Baghbanan, Uwe Erb, Gino Palumbo "Towards the application of nanocrystalline metals in MEMS" Physica Status Solidi (a), 203, 6, p. 1259-1264, 2006.

Eric W. Brooman, "Wear behavior of environmentally acceptable alternatives to chromium coatings: cobalt-based and other coatings" Metal Finishing, vol. 102, Issue 10, Oct. 2004, pp. 42-54.

M.A. Sheikholeslam, M.H. Enayati and K. Raeissi, "Characterization of nanocrystalline and amorphous cobalt—phosphorous electrodeposits" Materials Letters, vol. 62, Issues 21-22, Aug. 15, 2008, pp. 3629-3631.

Ms. Diana Facchini, Dr. Jonathan McCrea, Mr. Iain Brooks, Dr. Francisco Gonzalez, Dr. Gino Palumbo. "Electrodeposited Nanocrystalline Metals and Alloys as Environmentally Compliant Alternative Coatings to Functional Hexavalent Chromium and Cadmium" Aeromat 2009, Dayton OH, Jun. 9, 2009.

D. Facchini , N. Mahalanobis, F. Gonzalez, R. A. Prado, J. Benfer, K. Legg "Nanocrystalline Cobalt-Alloy Coatings for Chrome Replacement Applications" SERDP/ESTCP Partners in Environmental Technology Symposium, Washington DC, Dec. 1-3, 2009.

D. Facchini, Dr. Jon McCrea, Dr. Francisco Gonzalez, Dr. Gino Palumbo Ruben Prado, Dr. Keith Legg "Nanocrystalline Cobalt-Alloy Coatings for Chrome Replacement Applications" SERDP/ESTCP Partners in Environmental Technology Symposium, Washington DC, Dec. 2-4, 2008.

D. Facchini, J.L. McCrea, F. Gonzalez, R. Prado, K. Legg and G. Palumbo "Nanocrystalline Cobalt-Alloy Coatings for Non-Line-of-Sight Chrome Replacement Applications" SERDP/ESTCP Partners in Environmental Technology Sumposium, Washington DC, Dec. 4-6, 2007.

Diana Facchini, Ruben Prado "Electrodeposition of Nanocrystalline Co—P Coatings as a Hard Chrome Alternative", ASETS Defense Meeting, Denver, Colorado, Sep. 2, 2009.

Diana Facchini, Ruben Prado, Keith Legg "Electrodeposited Nano Co—P: Coating Development and Technology Insertion at NADEP-JAX" Surface Finishing and Repair Issues for Sustaining New Military Aircraft, Phoenix, Arizona, Feb. 27, 2008.

Paco Gonzalez, "Dem-Val of Electrodeposited Nano Co—P Alloys for NLOS Coating Applications at NADEP Jacksoville" HCAT Meeting, San Diego, California, Jan. 25, 2006.

Paco Gonzalez, "Electrodeposited nCoP as an Alternative to EHC", HCAT Meeting, Greensboro, North Carolina, Mar. 15-17, 2005.

(56) References Cited

OTHER PUBLICATIONS

Paco Gonzalez, "Nanocrystalline CoP for CR-Replacement", HCAT Meeting, Park City, Utah, Jul. 20-21, 2004.
Jonathan L. McCrea, Paco Gonzalez, Doug Lee and Uwe Erb "Electroformed Nanocrystalline Coatings An Advanced Alternative to Hard-Chrome Electroplating PP-1152" HCAT Meeting, Cape Canaveral, Florida, Nov. 18-19, 2003.
Douglas E. Lee, Dr. Jonathan L. McCrea, Dr. Uwe Erb, "Electroformed Nanocrystalline Coatings An Advanced Alternative to Hard-Chrome Electroplating PP-1152" HCAT Meeting, San Diego, California, Apr. 2, 2003.
Dr. Maureen J. Psaila-Dombrowski, Douglas E. Lee, Dr. Jonathan L. McCrea, Dr. Uwe Erb, "Electroformed Nanocrystalline Coatings An Advanced Alternative to Hard-Chrome Electroplating PP-1152" Toronto, Ontario, Sep. 26, 2002.
Dr. Maureen J. Psaila-Dombrowski, Douglas E. Lee, Dr. Jonathan L. McCrea, Dr. Uwe Erb, "Electroformed Nanocrystalline Coatings An Advanced Alternative to Hard-Chrome Electroplating PP-1152" HCAT Meeting, Toronto, Ontario, Aug. 30, 2001.
Nihad Ben Salah,S. Beskri and J. Sapieha, "Development of nano-Co—P plating as a replacement for hard chrome for engine components", SERDP/ESTCP Workshop—Surface finishing and repair issues, Tempe, Az, Feb. 26-28, 2008.
Dr. E.W. Brooman, Mr. T.A. Naguy, Dr. M.L. Klingenberg, "Evaluation of Alternatives to Hard Chromium Coatings for Air Force Repair and Overhaul Applications", SUR/FIN 2007, Cleveland, OH, Aug. 13-16, 2007.
McCrea, J.L., Facchini, D., Gonzalez, F. and Palumbo, G., "Nanocrystalline Cobalt-Alloy Coatings for Non-Line-of-Sight Chrome Replacement Applications," in Proceedings of SUR/FIN 2007, Cleveland, OH (2007).
International Search Report and Written Opinion of PCT/EP2011/058310 dated Aug. 1, 2011.
U.S. Appl. No. 12/785,662, filed May 24, 2010 and titled "Articles With Super-Hydrophobic and/or Self-Cleaning Surfaces and Method of Making Same".
U.S. Appl. No. 12/785,524, filed May 24, 2010 and titled "Metal-Clad Polymer Article".
U.S. Appl. No. 12/785,520, filed May 24, 2010 and titled "Electrodeposited Metallic Materials Comprising Cobalt".
Office Action of U.S. Appl. No. 12/785,662 dated Jun. 19, 2012.
Lee et al., Fabrication of Hierachical Structures on a Polymer Surface to Mimic Natural Superhydrophobic Surfaces, 2007, Adv. Mater., 19, 2330-2335.
Khan et al., Nanocrystalline aluminum and iron: Mechanical behavior at quasi-static and high strain rates, and constitutive modeling, 2006, Int. J. of Plasticity, 22, 195-209.
http://aluminum.matter.org.uk/content/html/eng/default.asp?catid=179&pageid=2144416668 (retrieved Jun. 12, 2012).
Feng et al., Super-Hydrophobic Surfaces: From Natural to Artificial, 2002, Adv. Mater. 14, 1857-1860.
Jack Champaigne Electronics Inc., Shot Peening Overview, 2001, 1-37.
Pacifico, Superhydrophobic Effects of Self-Assembled Monolayers on Micropatterned Surfaces: 3-D Arrays Mimicking the Lotus Leaf, Langmuir 2006, 22, 11072-11076.
Liu, et al., A Replication Strategy for Complex Micro/Nanostructures with Superhydrophobicity and Superoleophobicity and High Contrast Adhesion, Jun. 29, 2009, Soft Matter, vol. 5, pp. 3097-3105, 9 pages.
U.S. Office Action, U.S. Appl. No. 12/785,662, dated Nov. 21, 2012, 18 pages.
Bico et al., Wetting of textured surface, Colloids and Surfaces, A: Physicochemical and Engineering Aspects 206 (2002) 41-46.
Shibuichi et al., Super Water-Repellent Surface Resulting from Fractal Structure, J. Phy. Chem. 1996, 100, 19512-19517.

* cited by examiner

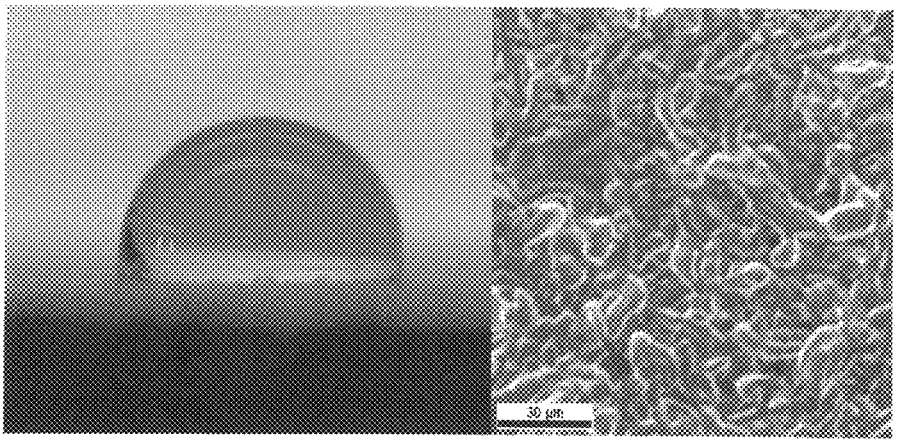
FIGURE 1 a/b
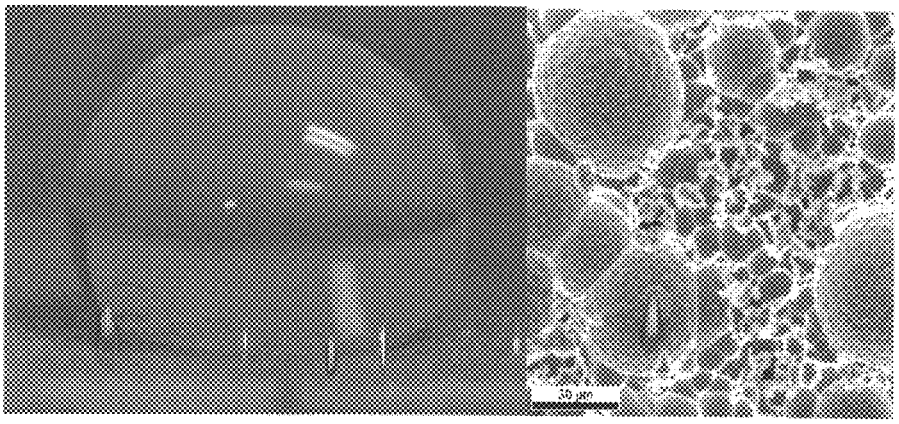
FIGURE 2 a/b

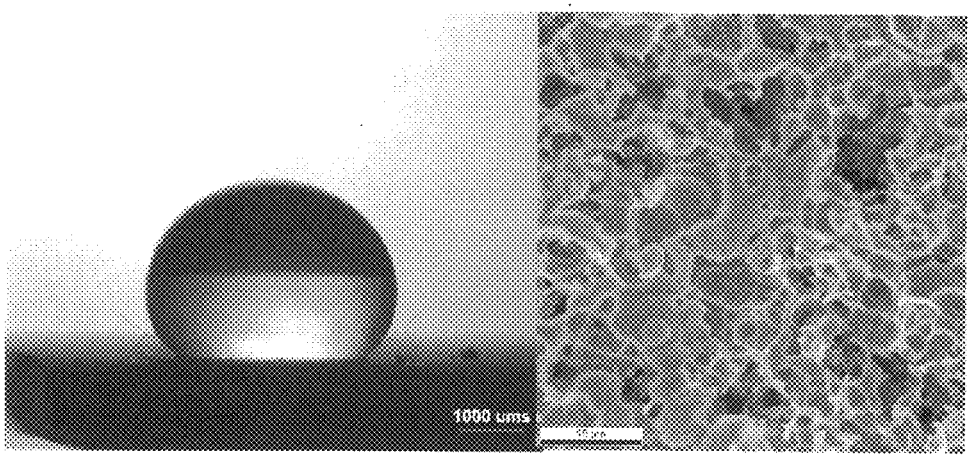
FIGURE 3 a/b
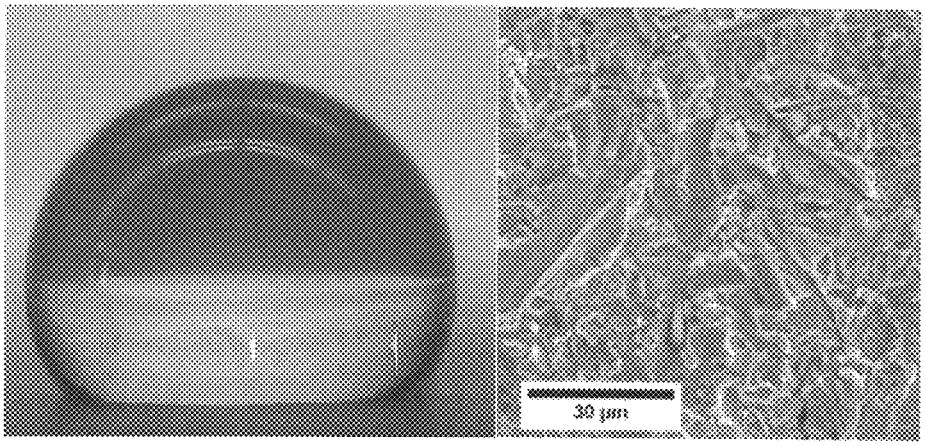
FIGURE 4 a/b

METALLIC ARTICLES WITH HYDROPHOBIC SURFACES

FIELD OF THE INVENTION

The present invention relates to an article having an exposed metallic surface comprising durable, fine-grained and/or amorphous microstructures which, at least in part, are rendered water repellant by suitably texturing and/or roughening the surface to increase the contact angle of the surface for fluids including water. The metallic surface has a dual microstructure including ultra-fine features equal to or less than 100 nm embedded in and overlaid on a surface topography with "macro-surface structures" equal to or greater than 1 micron, thus reducing the wetting behavior of the metallic surface, reducing corrosion and enabling efficient cleaning and drying.

BACKGROUND OF THE INVENTION

The present invention relates generally to a method of suitably texturing/roughening at least part of the exposed surface(s) of articles comprising amorphous and/or fine-grained metallic materials to render their surface fluid-repellant, particularly water-repellant by introducing a dual surface structure.

Water repellant (hydrophobic), super-hydrophobic and self-cleaning surfaces are desired in numerous applications involving, at least at times, exposure to the atmosphere or water. As metallic surfaces are inherently hydrophilic (contact angle for water less than 90°), hydrophobic surfaces (contact angle for water greater than 90°), according to the prior art, are created by coating the surface of metallic articles with a suitable inherently hydrophobic material, e.g., organic coatings. Organic coatings, however, suffer from chemical degradation, low hardness, creep, poor wear and abrasion resistance and poor adhesion. Consequently, rendering metallic surfaces water repellent without requiring the application of soft polymeric hydrophobic coatings of poor durability is therefore highly desirable.

Fine-grained and/or amorphous metallic materials, layers and/or coatings that are strong, hard, tough and aesthetic can be produced in free standing form or can be applied to a variety of substrates as layers and/or coatings by a number of commercial processes including, but not limited to, electroless deposition, electrodeposition, cold spraying, rapid solidification and severe plastic deformation.

Various patents that address the fabrication of fine-grained and/or amorphous metallic coatings and articles for a variety of applications are known.

U.S. Pat. No. 3,303,111 discloses amorphous nickel phosphorus (Ni—P) and/or cobalt phosphorus (Co—P) coatings using electroless deposition.

U.S. Pat. No. 4,529,668 discloses an electrodeposition process for depositing boron-containing amorphous alloys having high hardness and wear resistance and sufficient ductility to avoid cracking of the amorphous layer in fabrication and use.

U.S. Pat. No. 5,389,226 discloses amorphous and microcrystalline electrodeposited nickel-tungsten (Ni—W) coatings of high hardness, wear and corrosion resistance and low residual stress to avoid cracking and lifting of the coating from the substrate.

U.S. Pat. No. 5,032,464 discloses smooth ductile alloys of a transition metal and phosphorus, particularly nickel phosphorus (Ni—P) with high ductility (up to 10%) produced by electrodeposition.

U.S. Pat. No. 5,288,344 describes beryllium (Be)-bearing alloys which form amorphous metallic glasses upon cooling below the glass transition temperature at a cooling rate appreciably less than $10^6$ K/s.

U.S. Pat. No. 7,575,040 describes a process for continuous casting amorphous metal sheets by stabilizing the molten alloy at casting temperature, introducing the alloy onto a moving casting body, and quenching the molten alloy to solidify it.

U.S. Pat. No. 5,352,266 and U.S. Pat. No. 5,433,797, both having the same assignee as the present application, both describe a process for producing nanocrystalline materials, particularly nanocrystalline nickel. The nanocrystalline material is electrodeposited onto a cathode in an aqueous acidic electrolytic cell by application of a pulsed current. It is noted that the corrosion behavior of nanocrystalline nickel is different from polycrystalline nickel and suggested that, in the case of nanocrystalline nickel, uniform general corrosion is the dominant corrosion mechanism and neither pitting nor intergranular corrosion is observed.

U.S. Patent Publication No. 2005/0205425 and DE 10228323, both having the same assignee as the present application, disclose a process for forming coatings, layers or freestanding deposits of nanocrystalline metals, metal alloys or metal matrix composites. The process employs tank plating, drum plating or selective plating processes using aqueous electrolytes and optionally a non-stationary anode or cathode. Nanocrystalline metal matrix composites are disclosed as well.

U.S. Patent Publication No. 2009/0159451, which has a common assignee as the present application, discloses graded and/or layered, variable property electrodeposits of fine-grained and amorphous metallic materials, optionally containing solid particulates.

U.S. Ser. No. 12/548,750, which has a common assignee as the present application, discloses fine-gained and amorphous metallic materials comprising cobalt (Co) of high strength, ductility and fatigue resistance.

U.S. Ser. No. 12/785,662, which is a continuation-in part of U.S. Ser. No. 12/476,455, entitled "METAL CLAD POLYMER ARTICLE", and is filed concurrently with the present application, discloses metal-clad polymer articles comprising polymeric materials having fine-grained (average grain-size being about 2 nm to about 5,000 nm) and/or amorphous metallic materials of enhanced pull-off strength between the metallic material and the polymer which are optionally wet-proofed.

DE 10108893 describes the galvanic synthesis of fine-grained group II to group V metals, their alloys and their semiconductors compounds using ionic liquid or molten salt electrolytes.

U.S. Pat. No. 5,302,414 describes a cold gas-dynamic spraying method for applying a coating to an article by introducing metal or metal alloy powders, polymer powders or mixture thereof into a gas stream. The gas and particles, which form a supersonic jet having a velocity of about 300 to about 1,200 m/sec, are directed against a suitable substrate to provide a coating thereon.

U.S. Pat. No. 6,895,795 describes a method of processing a billet of metallic material in a continuous manner to produce severe plastic deformation. The billet is moved through a series of dies in one operation to produce a billet with a refined grain structure.

U.S. Pat. No. 5,620,537 describes a method of superplastic extrusion for fabricating complex-shaped, high strength metal alloy components by carefully controlling strain rate and temperature to retain an ultra-fine grained microstructure. A high strength, heat treatable metal alloy is first processed, such as by equal channel angular extrusion (ECAE), to have a uniform, equiaxed, ultra-fine grain size in thick section billet form.

U.S. Pat. No. 5,872,074 discloses leached nanocrystalline materials, specifically powders, having a high surface area for use as hydrogen storage material or as catalysts in the manufacture for fuel cell electrodes. The nanocrystalline material can be subjected to a leaching treatment in order to partially or totally eliminate one of the elements of the composite or alloy resulting in a porous structure and a high specific surface area.

The prior art also describes various means of increasing the water repellent properties of hydrophobic, predominantly polymeric surfaces by roughening.

U.S. Pat. No. 3,354,022 describes water repellent surfaces having an intrinsic advancing water contact angle of more than 90° and an intrinsic receding water contact angle of at least 75° by creating a micro rough structure with elevations and depressions in a hydrophobic material. The high and low portions have an average distance of not more than 1,000 microns. The average height of high portions is at least 0.5 times the average distance between them. The air content is at least 60% and, in particular, fluorine containing polymers are disclosed as the hydrophobic material. The water repellent surfaces are created by using an embossing die made of hollow polymer fibers. Unfortunately, such coatings have a disadvantageously low abrasion resistance and only a moderate self-cleaning effect.

U.S. Pat. No. 6,660,363 describes self-cleaning surfaces of objects made of hydrophobic polymers or permanently hydrophobized materials which have an artificial surface structure of elevations and depressions wherein the distances between the elevations are in the range of from 5 to 200 μm, and the heights of the elevations are in the range of from 5 to 100 μm. The elevations consist of hydrophobic polymers or permanently hydrophobized materials and the elevations cannot be wetted by water or by water containing detergents. This is accomplished by attaching PTFE particles (7 micron in diameter) to a polymer adhesive film containing surface and curing the structure or by using a fine mesh screen to emboss a polymer surface by hot pressing. According to the '363 patent, such surfaces are produced by application of a dispersion of powder particles of an inert material in a siloxane solution, and subsequent curing the siloxane solution to form a polysiloxane. Unfortunately, the structure forming particles do not adhere well to the surface of the substrate in an abrasion stable manner and thus the abrasion resistance is undesirably low.

U.S. Patent Publication No. 2003/0187170 discloses a process for producing nanostructured and microstructured polymer films by guiding the polymer through a gap formed by a suitably patterned roll, and a means which develops an opposing pressure so that the polymer film is deformed and shaped in accordance with a relief pattern. The relief pattern on the form tool is created by sandblasting, etching, laser ablation, lithographic techniques, offset printing, electroplating techniques, LIGA and/or erosion.

U.S. Pat. No. 6,764,745 describes a structural member in which high water-repellency can be obtained by forming appropriate irregularities on the external surface. The irregularities comprise protrusion portions of uniform height and shaped as prisms and which are subsequently coated with a water repellent film of PTFE or fluoroalkylsilane. The surface features termed "irregularities" are dimensioned such that a water droplet cannot fall into the air-filled recesses.

U.S. Pat. No. 6,872,441 describes glass, ceramic and metal substrates with at least one self-cleaning surface comprising a layer with a micro-rough surface structure which is arranged on the substrate and made at least partly hydrophobic. The layer contains a glass flux and structure-forming particles with a mean particle diameter within the 0.1 to 50 micron range. The micro-rough surface, structure has a ratio of mean profile height to mean distance between adjacent profile tips between 0.3 and 10. The surface layer is produced by coating the substrate with a composition containing a glass flux and structure-forming particles, and the layer is burnt in and made hydrophobic.

Thus prior art teaches that, in order to raise the contact angle for water by adding surface features to a material, the material inherently has to be non-wetting/hydrophobic. According to the prior art teachings, structurally modified but inherently wetting surfaces, such as metallic surfaces, would simply fill with water expelling the air and accordingly remain wetting/hydrophilic.

SUMMARY OF THE INVENTION

The Applicants have surprisingly discovered that the microstructure of the metallic material significantly affects the wetting behavior. Suitable surface texturing, in the case of fine-grained and amorphous metallic materials, can result in an increase in contact angle and render an inherently hydrophilic metallic material hydrophobic, a property that can not be readily achieved with conventional coarse-grained metallic materials.

The Applicants have also surprisingly discovered that, while fine-grained and amorphous microstructures yield a much improved hydrophobicity, the same results are difficult to obtain when materials with a coarse-grained microstructure are used. Unlike in the case of fine-grained and amorphous metallic materials, the surface of polycrystalline metals can not readily be textured to form desired nano- and microstructured features which appear to be responsible for raising the contact angle.

It is an objective of the present invention to render the external surfaces comprising strong and hard amorphous and/or fine-grained metallic material, having an inherent contact angle for water on a flat and smooth surface of less than 90°, water repellant by modifying the outer surface and suitably forming dual surface structures without the addition of additional hydrophobic materials or coatings.

It is an objective of the present invention to create or render wetting amorphous and/or fine-grained metallic material surfaces, having an intrinsic contact angle for water of less than 90°, water repellant by forming various recesses and depressions which extend inwardly from the original surface of the metallic material and/or by forming various elevations which protrude from the original surface of the metallic material.

It is an objective of the present invention to provide articles wherein the wetproofed metallic material extends over between 1% and 100% of the total exposed surface of the article.

It is an objective of the present invention to provide articles wherein the wetproofed metallic material extends over between 1% and 100% of the total fine-grained and/or amorphous exposed metallic material surface.

It is an objective of the present invention to provide durable, scratch and abrasion resistant, strong, lightweight articles comprising fine-grained and/or amorphous metallic materials for use in a large variety of applications, e.g., in parts for use in transportation applications (including automotive, aerospace, ships and other vessels navigating in and on water, and their components), defense applications, industrial components, electronic equipment or appliances and their components, sporting goods, molding applications, building materials and medical applications.

It is an objective of the present invention to provide a metallic coating/layer/article selected from the group of amorphous and/or fine-grained metals, metal alloys or metal matrix composites. The exposed metallic coating/layer/article comprises at least some fine-grained and/or amorphous metallic materials which can be produced in freestanding form or can be applied to suitable permanent substrates by a large variety of metal forming or deposition processes. Preferred metal deposition processes which can be used to produce a microstructure which is fine-grained and/or amorphous are selected from the group of electroless deposition, electrodeposition, physical vapor deposition (PVD), chemical vapor deposition (CVD), cold spraying and gas condensation. Other metal processing techniques for rendering the microstructure of metallic material fine grained (e.g., severe plastic deformation) or for rendering the microstructure amorphous (e.g. rapid solidification) are contemplated as well.

It is an objective of the present invention to provide single or multiple structural metallic layers having a microstructure selected from the group of fine-grained, amorphous, graded and layered structures, which have a total thickness in the range of between 1 micron and 2.5 cm, preferably between 50 micron and 2.5 mm and more preferably between 100 micron and 500 micron. The fine-grained and/or amorphous metallic material has a high yield strength (about 25 MPa to about 2,750 MPa) and ductility (about 0.1% to about 45%).

It is an objective of the present invention to utilize the enhanced mechanical strength and wear properties of fine-grained metallic coatings/layers with an average grain size between 1 and 5,000 nm, and/or amorphous coatings/layers and/or metal matrix composite coatings/layers. Metal matrix composites (MMCs) in this context are defined as particulate matter embedded in a fine-grained and/or amorphous metal matrix. MMCs can be produced, e.g., in the case of using an electroless plating or electroplating process, by suspending particles in a suitable plating bath and incorporating particulate matter into the deposit by inclusion or, e.g., in the case of cold spraying, by adding non-deformable particulates to the powder feed.

It is an objective of the present invention to provide hydrophobic metallic surfaces capable of retaining the hydrophobic behavior when exposed to erosion and wear during use.

It is an objective of the present invention to provide hydrophobic metallic materials exhibiting a wear rate on ASTM G65 of less than 25 $mm^3$ at a force of about 45N, a speed of about 20.9 rad/sec for a total of about 200 revolutions in about 60 seconds.

It is an objective of the present invention to suitably roughen or texture at least portions of the metallic surfaces to form a large number of recesses/dents/cavities of specific surface morphologies on the exposed surface, termed "surface structures" or "surface sites" per unit area. The elimination of smooth surfaces also provides for additional surface area for adhesion, increases the bond strength and reduces the risk of delamination and/or blistering in case there is a desire to subsequently apply a finishing coating.

It is an objective of the present invention to suitably texture at least portions of the metallic surfaces to form a large number of elevations/protrusions per unit area also termed "surface structures" or "surface sites". Elevations can also be formed on a metallic layer by suitably texturing a mold surface and applying the fine grained and/or amorphous metallic material to the mold surface, e.g., by electroless or electrodeposition, followed by removal of the metallic layer from the mold.

It is an objective of the present invention to optionally coat the suitable patterned and textured metallic surface by applying a top coat comprising a metallic, ceramic or organic coating.

It is an objective of the present invention to suitably create numerous pits and crevices or protrusions in at least portions of the outer surface of the metallic material that are randomly and/or evenly distributed which result in an increase in the contact angle. The shape, size and population of sites such as elevations, recesses, pits, crevices, depressions and the like is believed to enable the entrapment of air thus providing for the "lotus" or "petal" effect. It is an objective to create recessed-structures (hereafter referred to as micron-sized surface structures, macro-surface structures or primary structures) exceeding a density of between 25 and 10,000, preferably between 100 and 5,000 sites per $mm^2$ area or a range of between 5 and 100 sites per mm. Surface structures dimensions range from 1-1,000 micron; specifically from 5-100 micron in depth/height, preferably from 10-50 micron in diameter, spaced between 5-100 micron apart, preferably between 10 and 50 micron apart.

It is an objective of the present invention to suitably overlay the primary surface features with an ultra-fine pattern/roughness of secondary surface features which can be conveniently created using metallic materials for embossing dies having a fine-grained and/or amorphous microstructure.

It is an objective of the present invention to render inherently hydrophilic metallic material surfaces hydrophobic by introducing surface structures therein containing a plurality of micron-sized features, wherein the plurality of micron-sized features furthermore preferably has a substructure comprising of a plurality of nanoscale features, i.e., the surface sites contain both micro and nanostructured features.

It is an objective of the present invention to suitably create a self-cleaning metallic surface preferably having a low roll off angle and/or high contact angle for water by an economic, convenient and reproducible process.

It is an objective of the present invention to apply a fine-grained and/or amorphous metallic coating to at least a portion of the surface of a part made substantially of any suitable material, including, but not limited to metals, polymers, wood, graphite, ceramics and composites and to suitably modify at least portions of said metallic coating surface to render it hydrophobic.

According to the present invention, patches or sleeves which are not necessarily uniform in thickness can be employed in order to, e.g., enable a metallic thicker coating on selected sections or areas of articles particularly prone to heavy use, such as in the case of selected aerospace and automotive components, sporting goods, consumer products, electronic devices, building materials and the like.

It is an objective of the present invention to harden or oxidize the surface of the metallic material by a suitable heat treatment in a suitable atmosphere. Suitable heat treatments preferably range from between 5 minutes and 50 hours at between 50 and 500° C.

It is an objective of the present invention to provide lightweight articles comprising, at least in part, liquid repellent fine-grained and/or amorphous metal surfaces with increased wear, erosion and abrasion resistance, durability, strength, stiffness, thermal conductivity and thermal cycling capability.

It is an objective of the present invention to provide articles consisting of or coated with fine-grained and/or amorphous metallic layers that are stiff, lightweight, resistant to abrasion, erosion or other forms of wear, and resistant to permanent deformation for a variety of applications including, but not limited to:

(i) applications requiring cylindrical objects including gun barrels; shafts, tubes, pipes and rods; golf and arrow shafts; skiing and hiking poles; various drive shafts; fishing poles; baseball bats, bicycle frames, ammunition casings, wires and cables and other cylindrical or tubular structures for use in commercial goods;

(ii) medical equipment including orthopedic prosthesis; implants; surgical tools; crutches; wheel chairs; as well as touch surfaces in healthcare environments;

(iii) sporting goods including golf shafts, heads and faceplates; lacrosse sticks; hockey sticks; skis and snowboards as well as their components including bindings; racquets for tennis, squash, badminton; bicycle parts;

(iv) components and housings for electronic equipment including laptops; televisions and handheld devices including cell phones; personal digital assistants (PDAs) devices; walkmen; discmen; digital audio players, e.g., MP3 players and e-mail functional telephones, e.g., a BlackBerry®-type device; cameras and other image recording devices;

(v) automotive components including heat shields; cabin components including seat parts, steering wheel and armature parts; fluid conduits including air ducts, fuel rails, turbocharger components, oil, transmission and brake parts, fluid tanks and housings including oil and transmission pans; cylinder head covers; spoilers; grillguards and running boards; brake, transmission, clutch, steering and suspension parts; brackets and pedals; muffler components; wheels; brackets; vehicle frames; fluid pumps such as fuel, coolant, oil and transmission pumps and their components; housing and tank components such as oil, transmission or other fluid pans including gas tanks; electrical and engine covers;

(vi) industrial/consumer products and parts including linings on hydraulic actuator, cylinders and the like; drills; files; saws; blades for knives, turbines and windmills; sharpening devices and other cutting, polishing and grinding tools; housings; frames; hinges; sputtering targets; antennas as well as electromagnetic interference (EMI) shields;

(vii) molds and molding tools and equipment;

(viii) aerospace parts and components including wings; wing parts including flaps and access covers; structural spars and ribs; jet engine parts, propellers; rotors; stators; actuators; journals; rudders; covers; housings; fuselage parts; nose cones; landing gear; lightweight cabin parts; cryogenic storage tanks; ducts and interior panels;

(ix) military products including ammunition, armor as well as firearm components, and the like; that are coated with fine-grained and/or amorphous metallic layers that are stiff, lightweight, resistant to abrasion, resistant to permanent deformation, do not splinter when cracked or broken and are able to withstand thermal cycling without degradation; and (x) marine parts and components including boat hulls, rudders and propellers.

It is an objective of the present invention to at least partially coat the inner or outer surface of parts including complex shapes with fine-grained and/or amorphous metallic materials that are strong, lightweight, have high stiffness (e.g. resistance to deflection and higher natural frequencies of vibration) and have hydrophobic surfaces or surfaces rendered hydrophobic by a suitable treatment as described herein.

Accordingly, the invention in one embodiment is directed to an article comprising a metallic material positioned on the article. The metallic material has at least one of a microstructure which is fine-grained with an average grain size between 2 nm and 5,000 nm and an amorphous microstructure. The metallic material forms at least part of an exposed surface of the article. The metallic material has at least an exposed surface portion having structures incorporated therein to increase the contact angle for deionized water at room temperature to over 100 degrees. The metallic material has an inherent contact angle for deionized water at room temperature of less than 90 degrees when measured on a smooth exposed surface portion of the metallic material.

Accordingly, the invention in another embodiment is directed to an article comprising an inherently hydrophilic metallic material which forms at least part of a surface of the article. The metallic material has one of a microstructure which is fine-grained with an average grain size between 2 and 5,000 nm and an amorphous microstructure. The metallic material has at least an exposed surface portion having surface structures incorporated therein to increase the contact angle for deionized water at room temperature to over 90 degrees and render the inherently hydrophilic surface of the metallic material hydrophobic. The exposed surface of the metallic material is formed into a dual surface structure rendering the exposed surface hydrophobic without modifying the exposed surface with additional hydrophobic materials.

Accordingly, the invention in yet another embodiment is directed to an article comprising an inherently hydrophilic metallic material located on at least part of a surface of the article. The metallic material has one of a microstructure which is fine-grained with an average grain size between 2 and 5,000 nm and an amorphous microstructure. At least an exposed surface portion of the metallic material is imprinted with surface sites to raise the contact angle for deionized water in the imprinted surface portion by at least 10° at room temperature when compared to a smooth exposed surface of the metallic material of the same composition as the imprinted surface portion.

Accordingly, the invention in still yet another embodiment is directed to a method for manufacturing an article having a hydrophobic metallic surface covering a surface of the article comprising:

(i) providing a hydrophilic metallic material having at least one of a microstructure which is fine-grained with an average grain size between 2 and 5,000 nm and an amorphous microstructure, (ii) incorporating surface structures into at least a portion of an exposed surface of the hydrophilic metallic material to render said portion of the exposed surface hydrophobic and increase the contact angle for deionized water in the surface structured portions to equal to or greater than 100 degrees at room temperature.

As used herein, the term "contact angle" or "static contact angle" is referred to as the angle between a static drop of deionized water and a horizontal surface upon which the droplet is placed.

As used herein, the "inherent contact angle" or "intrinsic contact angle" is characterized by the contact angle for a liquid measured on a flat and smooth surface not containing any surface structures, e.g., a metallic surface obtained by conventional metal forming processes such as casting, rolling, extrusion, electroplating and the like.

As used herein, the term "smooth surface" is characterized by a surface roughness (Ra) less than or equal to 0.25 microns.

As is well known in the art, the contact angle is used as a measure of the wetting behavior of a surface. If a liquid spreads completely on the surface and forms a film, the contact angle is zero degrees (0°). As the contact angle increases, the wetting resistance increases, up to a theoretical maximum of 180°, where the liquid forms spherical drops on the surface. The term "wet-proof" is used to describe surfaces having a high wetting resistance to a particular reference liquid; "hydrophobic" is a term used to describe a wetting resistant surface where the reference liquid is water. As used herein, the term "wetproof" and "hydrophobic" refers to a surface that generates a contact angle of equal to or greater than 90° with a reference liquid. As the wetting behavior depends in part upon the surface tension of the reference liquid, a given surface may have a different wetting resistance (and hence form a different contact angle) for different liquids. As used herein, the term "substrate" is not construed to be limited to any shape or size, as it may be a layer of material, multiple layers or a block having at least one surface of which the wetting resistance is to be modified.

A "wetting-resistant surface" exhibits resistance to wetting by water, such as deionized water. However, the use of other liquids including organic liquids, such as, for example, alcohols, hydrocarbons, and the like, are contemplated as well.

As used herein the term "hydrophilic" is characterized by the contact angle for water of less than 90°, which means that the water droplet wets the surface.

As used herein the term "hydrophobic" is characterized by the contact angle for water of greater than 90°, which means that the water droplet does not wet the surface.

As used herein, "super-hydrophobicity" refers to a contact angle for deionized water at room temperature equal to or greater than 150° and "self-cleaning" refers to a tilt angle of equal to or less than 5°.

As used herein the term "lotus effect" is a naturally occurring effect first observed on lotus leaves and is characterized by having a randomly rough surface and low contact angle hysteresis, which means that the water droplet is not able to wet the microstructure spaces between the spikes. This allows air to remain inside the texture, causing a heterogeneous surface composed of both air and solid. As a result, the adhesive force between the water and the solid surface is extremely low, allowing the water to roll off easily and to provide the "self-cleaning" phenomena.

As used herein the term "petal effect" is based on micro- and nanostructures observed on rose petals'. These structures are larger in scale than the lotus leaf, which allows the liquid film to impregnate the texture. While the liquid can enter the larger scale grooves, it cannot enter into the smaller grooves. Since the liquid can wet the larger scale grooves, the adhesive force between the water and solid is very high. The water drops maintain their spherical shape due to the superhydrophobicity of the petal (contact angle of greater than 150°). This explains why the water droplet will not fall off even if the petal is tilted at an angle or turned upside down.

As used herein "texturing" or "roughening" the surface means that the nature of a surface is not smooth but has a distinctive rough texture created by the surface structures introduced to render the surface fluid repellant.

As used herein, the term "coating" means deposit layer applied to part or all of an exposed surface of a substrate.

As used herein, the term "coating thickness" or "layer thickness" refers to depth in a deposit direction and typical thicknesses exceed about 50 micron, preferably about 100 micron to accommodate the height/depth of the surface features required to obtain the lotus or petal effect.

As used herein, the term "variable property" is defined as a deposit property including, but not limited to, chemical composition, grain size, hardness, yield strength, Young's modulus, resilience, elastic limit, ductility, internal stress, residual stress, stiffness, coefficient of thermal expansion, coefficient of friction, electrical conductivity, magnetic coercive force, and thickness, being varied by more than 10% in the deposition direction and/or at least in one of the length or width directions. "Layered structures" have said deposit property varied by more than 10% between sublayers and the sublayer thickness ranges from 1.5 nm to 1,000 microns.

As used herein, "exposed surface" refers to all accessible surface area of an object accessible to a liquid. The "exposed surface area" refers to the summation of all the areas of an article accessible to a liquid.

As used herein, the term "surface structures" or "surface sites" refers to surface features including recesses, pits, crevices, dents, depressions, elevations protrusions and the like purposely created in the metallic material to decrease its wetability and increase the contact angle.

As used herein, the term "population of primary surface structures" refers to number of primary, micron sized, surface features per unit length or unit area. The "linear population of surface sites" can be obtained by counting the number of features, e.g., on a cross sectional image and normalizing it per unit length, e.g., per mm. The average "areal population of surface sites" is the square of the average linear population, e.g., expressed in $cm^2$ or $mm^2$. Alternatively, the average areal density can be obtained by counting the number of features visible in an optical micrograph, SEM image or the like and normalizing the count for the measurement area.

As used herein, "surface roughness", "surface texture" and "surface topography" mean a regular and/or an irregular surface topography containing surface structures. Surface roughness consists of surface irregularities which result from the various surface preconditioning methods used such as mechanical abrasion and etching to create suitable surface structures. These micro-surface irregularities/surface structures, ranging in height, width and depth equal to or greater than 1 micron, combine to form the "primary surface texture" presumably retaining air and are believed to be responsible for the increase in contact angle/contact angle when compared to a flat surface, particularly, when these features also contain sub-texturing or secondary texturing on the nanoscale, i.e., additional features overlaying the primary structures, which have dimensions equal to or less than 100 nm.

As used herein "erosion and wear during use" refers to predominantly abrasive conditions experienced during e.g. outdoor service, such as rain, hail and snow and sand erosion and/or wear and erosion caused by particulates included in liquids such as sand/water and can be determined using a number of standardized tests know to the person skilled in the art.

A number of standardized accelerated wear tests are available which can be used to measure the abrasion of metal and polymer surfaces which include dry and wet tests. They include the Taber wear test (ASTM D 4060 and ASTM F1978) where the wear on the sample is generated by rotating wheel. In ASTM D1242 Procedure A, loose abrasive is distributed on rotating platens. ASTM G65 is a low stress sliding abrasion test involving the sample, dry-sand and a rubber wheel. ASTM G65 entitled "Standard Test Method for Measuring Abrasion Using the Dry Sand/Rubber Wheel Apparatus" is particularly suited to measure the abrasion resistance of hard and soft materials. Using a 60Shore A rubber wheel as abrader at a speed of about 20.9 rad/sec for a total of about 200 wheel revolutions (60 sec) and a loading force of the specimen against the wheel of about 45 N force, it was determined that flat and patterned fine-grained and/or amorphous metallic samples exhibited a wear rate of less than 25 $mm^3$ whereas polymeric materials ranged from 50 to 800 $mm^3$ (glass and carbon reinforced polymers).

Similarly, wet sand rubber wheel abrasion tests can be performed as, e.g., specified in ASTM G105. Slurry abrasion tests applicable to metals and polymers include ASTM G 75.

According to one aspect of the present invention, an article is provided by a process which comprises the steps of positioning the metallic or metalized work piece to be plated in a plating tank containing a suitable electrolyte and a fluid circulation system, and providing electrical connections to the work piece/cathode to be plated and to one or several anodes and plating a structural layer of a metallic material with an average grain size of equal to or less than 5,000 nm on the surface of the metallic or metalized work piece using suitable direct current (D.C.) or pulse electrodeposition processes, such as those described in U.S. Patent Publication No. 2005/0205425 and DE 10228323. Appropriate surface sites are generated on at least portions of the metallic surface, e.g., by applying at least one process selected from the group of mechanical abrasion, shot-peening, anodic dissolution, anodic assisted chemical etching, chemical etching and plasma etching. Other applicable methods include, but are not limited to, micro- and nano-machining, micro-stamping, micro-profiling and laser ablation. It is understood that the use of such processes, while generally modifying the surface, does not inadvertently yield hydrophobic surfaces and that not each and every process under each and every arbitrary process condition will yield the desired increase in contact angle. Applicants have discovered that the process sequence of processing steps and process parameters need to be suitably adjusted and optimized to achieve the desired population and dimensions of surface sites to yield the desired liquid repellency. For example, in the case of using shot-peening, depending on the hardness of the surface to be modified, the peening media hardness and size, the peening pressure and the peening duration may need to be optimized to achieve the surface sites required for raising the contact angle. Similarly, in the case of etching, for example, depending on the chemical composition of the surface, the etching media, process temperature and duration may need to be optimized to establish the surface sites required for raising the contact angle.

Articles of the present invention comprise a single or several fine-grained and/or amorphous metallic layers as well as multi-layer laminates composed of alternating layers of fine-grained and/or amorphous metallic layers which are free standing or are applied as coatings to at least a portion of a suitable substrate.

The fine-grained metallic coatings/layers have a grain size under 5 μm (5,000 nm), preferably in the range of 5 to 1,000 nm, more preferably between 10 and 500 nm. The grain size can be uniform throughout the deposit; alternatively, it can consist of layers with different, e.g. alternating, microstructure/grain size. Amorphous microstructures and mixed amorphous/fine-grained microstructures are within the scope of the invention as well.

The fine-grained and/or amorphous metallic layers can contain particulates dispersed therein, i.e., the layers can be metal matrix composites (MMCs). The particulates can be permanently retained within the metal matrix and/or they can be chosen to be soluble in the etchant to further enhance the desired size and population of surface structures contributing to the rise in contact angle.

According to the present invention, the entire surface of the article can comprise the wetproofed metallic material; alternatively, metal patches or sections can be formed on selected areas, patches or portions only (e.g. leading edges of automotive or aerospace parts), without the need to coat the entire article.

According to the present invention, metal patches or sleeves which are not necessarily uniform in thickness and/or microstructure can be deposited in order to, e.g., enable a thicker coating on selected sections or sections particularly prone to heavy use and/or exposure to water in all of its forms, i.e., accumulations of sea or fresh water, rain, hail, snow, ice, or wet surfaces such as golf club face or sole plates, automotive and aerospace components and the like.

According to the present invention, laminate articles in one aspect comprise fine-grained and/or amorphous metal layers in free-standing form or on a suitable substrate, e.g., on carbon-fiber and/or glass fiber filled polymeric substrates.

The following listing further defines the exemplary metallic material forming at least part of the surface of the exemplary article of the invention:

Metallic Coating/Metallic Layer Specification

Metallic materials comprising at least one element selected from the group consisting of Ag, Al, Au, Co, Cr, Cu, Fe, Ni, Mo, Pb, Pd, Pt, Rh, Ru, Sn, Ti, W, Zn and Zr. Other alloying additions optionally comprise at least one element selected from the group consisting of B, C, H, O, P and S.

Particulate additions optionally comprising at least one material selected from the group consisting of: metals and metal oxides selected from the group consisting of Ag, Al, In, Mg, Si, Sn, Pt, Ti, V, W, Zr, Zn; carbides and nitrides, including, but not limited to, Al, B, Cr, Bi, Si, W; carbon (carbon nanotubes, diamond, graphite, graphite fibers); glass; self lubricating materials including, but not limited to, $MoS_2$, $WS_2$, polymeric materials (PTFE, PVC, PE, PP, ABS, epoxy resins). Particulate additions are preferably in the form of powders, fibers, nanotubes, flakes, and the like.

| | |
|---|---|
| Microstructure: | Amorphous or crystalline |
| Minimum average grain size [nm]: | 2; 5; 10 |
| Maximum average grain size [nm]: | 100; 500; 1,000; 5,000; 10,000 |
| Metallic layer Thickness Minimum [μm]: | 1; 10; 25; 30; 50; 100 |
| Metallic layer Thickness Maximum [mm]: | 1; 5; 25; 100 |
| Minimum particulate particle size [μm]: | 0.01; 0.1 |
| Maximum particulate particle size [μm]: | 5, 10 |
| Minimum particulate fraction [% by volume]: | 0; 1; 5; 10 |
| Maximum particulate fraction [% by volume]: | 50; 75; 95 |
| Minimum Yield Strength Range [MPa]: | 100; 300 |
| Maximum Yield Strength Range [MPa]: | 2,750 |
| Minimum Hardness [VHN]: | 50; 100; 200; 400 |
| Maximum Hardness [VHN]: | 800; 1,000; 2,000 |
| Minimum contact angle on smooth surface for deionized water at room temperature [°]: | 0, 25, 50 |
| Maximum contact angle on smooth surface for deionized water at room temperature [°]: | 87, 90 |

| Wetproofed (Textured) Metallic Layer Surface Specification: | |
|---|---|
| Minimum contact angle on textured surface for deionized water at room temperature [°]: | ≥90, ≥100, ≥105; ≥110; ≥120; ≥130, ≥140 |
| Maximum contact angle on textured surface for deionized water at room temperature [°]: | 150, 180 |
| Minimum increase in contact angle for deionized water at room temperature of the modified and textured surface when compared to the flat and smooth surface of the same composition [°]: | 5, 10, 20, 30, 40 |
| Maximum increase in contact angle for deionized water at room temperature of the modified and textured surface when compared to the flat and smooth surface of the same composition [°]: | 50, 90 |
| Minimum linear population of micron-sized primary surface structures [number per mm]: | 3, 5, 10 |
| Maximum linear population of micron-sized primary surface structures [number per mm]: | 100; 1,000 |
| Minimum areal population of micron-sized primary surface sites [number per $mm^2$]: | 10, 25, 100 |
| Maximum areal population of micron-sized primary surface sites [number per $mm^2$]: | 5,000; $10^4$, $10^5$; $10^6$ |
| Minimum micron-sized primary surface structure diameter, height/depth or spacing [μm]: | 1; 5; 10 |
| Maximum micron-sized primary surface structure diameter, height/depth or spacing [μm]: | 50; 100; 250; 500; 1,000 |
| Surface structure topography: | recesses; cavities; pits, pitted surface structures; holes; pores; depressions; grooved, roughened and etched surface sites; or open foam type structures; "brain", "cauliflower", "worm", "coral", "treed", elevations, protrusions and other three dimensionally interconnected porous surface structures |
| Minimum ultra-fine-sized secondary surface structure diameter [nm]: | Less than 1, 1, 2 |
| Maximum ultra-fine-sized secondary surface structure diameter [nm]: | 50, 75, 100 |

Typically any number of different surface structures is present in the suitably textured surface, their shapes and areal densities can be irregular and the clear identification of individual surface structures can, at times, be subject to interpretation.

Surface sites generated with selected processes described herein include shot-peening, other forms of abrasive blasting and etching typically which are inexpensive and yield a somewhat random distribution of surface sites. Regularly spaced and sized primary surface sites of defined shape and uniform size can be created by micromachining (e.g., laser scribing, laser ablation and micro- and nano-machining) or LIGA processes to a preform, followed by deposition of the fine-grained and/or amorphous material into these "mold preforms", followed by removal of the fine-grained and/or amorphous metallic layer from the preform molds. The micron sized recesses can further contain an additional substructure, for example, sub-micron sized structures as observed in lotus leaves or rose petals. An exemplary method to characterize such surfaces sites is to measure their contact angle for deionized water at room temperature which is a reliable and reproducible property.

BRIEF DESCRIPTION OF THE DRAWINGS

In order to better illustrate the invention by way of examples, descriptions are provided for suitable embodiments of the method/process/apparatus according to the invention in which:

FIG. 1*a* illustrates a picture of a water droplet (contact angle 91°) on a patterned coarse-grained Ni-surface (average grain size: 30 μm) according to one process of the invention (shot-peening, followed by chemical etching).

FIG. 1*b* depicts a magnified image of the patterned coarse-grained Ni surface.

FIG. 2*a* illustrates a picture of a water droplet (contact angle 144°) on a patterned fine-grained Ni-surface (average grain size: 15 nm) according to one process of the invention (shot-peening, followed by chemical etching).

FIG. 2*b* depicts a magnified image of the patterned fine-grained Ni surface.

FIG. 3*a* illustrates a picture of a water droplet (contact angle 148°) on a patterned amorphous Co—$Al_2O_3$-graphite metal matrix composite-surface (average grain size: 25 nm) according to one process of the invention (shot-peening, followed by chemical etching).

FIG. 3*b* depicts a magnified image of the patterned fine-grained Co—$Al_2O_3$-graphite surface.

FIG. 4*a* illustrates a picture of a water droplet (contact angle 132°) on a patterned amorphous Co-9P-surface according to one process of the invention (shot-peening, followed by chemical etching).

FIG. 4*b* depicts a magnified image of the patterned fine-grained Co-9P surface.

DETAILED DESCRIPTION

Figure 5:
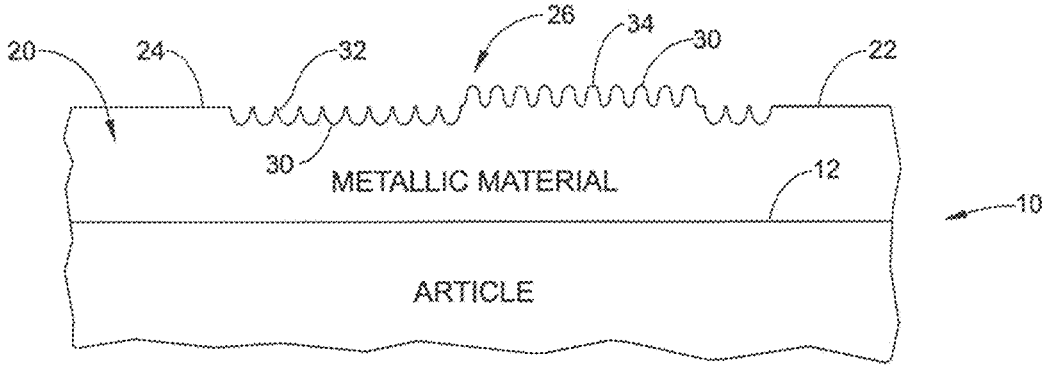
FIG. 5 depicts a simplified schematic view of an exemplary article according to the present invention.

The present invention relates to metallic articles and/or metallic coatings that, while inherently being hydrophilic, are rendered hydrophobic by suitably modifying or processing the surface. The metallic materials/coatings are fine-grained and/or amorphous and are produced by a number of convenient processes including, but not limited to, DC or pulse electrodeposition, electroless deposition, physical vapor deposition (PVD), chemical vapor deposition (CVD) and gas condensation or the like. Other processing techniques for forming the desired microstructure include, but are not limited to, rapid solidification and severe plastic deformation. The intrinsic contact angle for water of less than 90° when measured on a flat and smooth surface is significantly increased to render the surface of the metallic coating hydrophobic (contact angle for water equal to or greater than 90°, preferably equal to or greater then 100°, more preferably equal to or greater than 110°) and even more preferably superhydrophobic (contact angle for water equal to or greater than 150°). The increase in hydrophobicity is achieved by suitably shaping or processing the surface to create surface sites to the extent required to affect the wetting behavior.

As highlighted, a variety of fine-grained and/or amorphous metallic materials, which at room temperature have contact angle for water of less than 90° as formed, can be employed.

The microstructure of metallic materials can be coarse-grained, fine-grained or amorphous. One or more metallic coating layers of a single or several chemistries and microstructures can be employed. The metallic materials are suitably processed to create surface features raising the contact angle for water and rendering the inherently hydrophilic material surface hydrophobic. In contrast, the prior art teaches that, in order to raise the contact angle by adding surface features to a material, the material inherently has to be hydrophobic. According to the prior art teachings structurally modified but inherently hydrophilic surfaces would simply fill with water expelling the air and accordingly remain hydrophilic.

Applicants have surprisingly discovered that the microstructure of the metallic material significantly affects the wetting behavior and suitable surface texturing can result in an increase in contact angle and render an inherently hydrophilic metallic material hydrophobic.

Applicants have also surprisingly discovered that, while fine-grained and/or amorphous microstructures containing the desired dual-scale roughness yield a much improved hydrophobicity when processed according to the present invention, the same results could not be obtained with coarse-grained metallic materials.

The patterned, hydrophobic metallic material surface can be optionally at least partly subjected to a suitable finishing treatment, which can include, among others, electroplating, i.e., chromium plating and applying a polymeric material, i.e., paint or adhesive.

Numerous attempts have been made to identify, characterize and quantify desired surface features which result in achieving the desired wetting properties and to quantify the surface topography and surface roughness in quantifiable scientific terms. Heretofore, these efforts have not succeeded in part because of the complexity of the surface features and the numerous parameters such as population, size and shape of the surface structures which affect the contact angle. Furthermore, the metal surface can be at least partially oxidized by a suitable chemical and/or heat treatment or surface oxidation occurs naturally with time. Furthermore the surface can collect and retain dust or other foreign objects.

According to the present invention, surface structures are suitably created on the metallic surface by various surface conditioning methods including, but not limited to, mechanical abrasion, shot-peening, anodic dissolution, chemical etching and plasma etching. To obtain the desired results the composition of the metallic material and in the case of metal matrix composites (MMCs) the amount, size and shape of particulate fillers employed, need to be considered. In practice when texturing metallic surfaces according to preferred economic processes of the invention, surface features are usually quite irregular and difficult to describe/measure in absolute terms and attempts to quantify surface features responsible for increasing the contact angle, have not been completely successful to date.

According to the present invention, desired surface sites responsible for increasing the contact angle on the metallic material can be generated in several ways:

1. Mechanical Surface Roughening of the Metallic Material Surface:

The metallic surface can be suitably roughened by a mechanical process, e.g., by sanding, grit blasting (shot-peening), grinding and/or machining. Shot-peening proved to be a particularly suitable process.

2. Chemical Etching of the Metallic Material-Surface:

Chemical etching using oxidizing chemicals such as mineral acids, bases and/or oxidizing compounds such as permanganates is the most popular method practiced in industry.

"Electrochemical Etching", too, is a suitable surface activation process.

Solvent-free chemical etching can be employed as well, to etch and/or suitably texture the outer surface including plasma etching or etching with reactive gases including, but not limited to, $SO_3$ and $O_3$, to suitably precondition and texture the metallic surface.

3. Deposition of the Metallic Material on Suitable Precursor Substrates:

Desirable surface sites can be obtained on the surface of "preforms" by a variety of means followed by deposition of the fine-grained and/or amorphous metallic material into the preforms and subsequent removal of the deposited metallic materials from the performs. Suitable preforms can include metallic preforms that are suitably machined and/or polymeric preforms, prepared by suitable polymer molding, stamping, forming and/or shaping methods applying pressure to the soft, softened or molten polymer surface, including but not limited to injection and compression molding, and "print rolling", followed by metalizing and use as preforms as described. The metallic materials can then be, e.g., suitably galvanically deposited on such "preforms" or "surface molds" serving as temporary cathodes.

4. Micro- and Nanomachining of the Metallic Material-Surface:

A number of machining or laser based material-removal methods are available to create virtually any desired surface topography, including highly regular surface patterns.

Combinations of two or more of the aforementioned processes can be used as well and the specific treatment conditions typically need to be optimized to maximize the change in contact angle as highlighted with shot-peening followed by etching producing particularly favorable results.

Suitable hydrophobic articles comprising the hydrophobic metallic materials include, but are not limited to, molds used in aerospace, automotive, building material and other industrial applications. Carbon/graphite-fiber polymer composites are a popular choice for lightweight aerospace components including plane fuselage, wings, rotors, stators, propellers and their components as well as other external structures that are prone to erosion by the elements including wind, rain, sand, hail and snow or can be damaged with impact by debris, stones, birds and the like. Transportation (aerospace, automotive, ships), consumer and defense applications particularly benefit from strong, tough, hard, erosion-resistant fine-grained and/or amorphous outer layers/coatings and/or laminates and/or graded structures with hydrophobic surfaces.

The following working examples illustrate the benefits of the invention, reporting the static contact angle for deionized water on metallic materials of various microstructures and with and without textured surfaces according to the invention, specifically for fine-grained, coarse-grained and amorphous Ni or Co based metallic materials (Working Example I), the static contact angle for water of fine-grained and coarse-grained nickel as well as amorphous Co-9P processed by various surface treatments (Working Example II), and the wear loss and change of the static contact angle with time of hydrophobic surfaces prepared by various methods when exposed to abrasive conditions (Working Example III).

WORKING EXAMPLE I

Comparison of Contact Angle on Coarse-Grained, Fine-Grained and Amorphous Metallic Surfaces Processed According to the Invention In this example, 10×10 cm metallic coupons were used. To achieve a reproducible and comparable surface, the surface used for contact angle measurement was initially ground flat up to 2400 grit SiC paper, rinsed in ethanol, ultrasonically cleaned in ethanol and air dried at room temperature. To eliminate any potential contamination, no polishing compounds were employed. Subsequently, the contact angle of the "uniformly flat and smooth surfaces" was measured. In all cases the contact angle was measured by placing multiple 5 μl droplets of deionized water on the flat sample surface and taking a picture with a stereoscope at 15× magnification after properly aligning the camera with the horizontal plane of the sample. Contact angle measurements were taken from the digitally captured images using the Image-pro software in triplicates on both sides of each droplet. In all cases the average of all contact angle measurements is reported.

After the contact angle measurements on the flat and smooth surfaces were completed, the very same surfaces on which the measurements were made were suitably patterned as follows: all samples were shot-peened at about 87 psi (10 passes) using 180 grit alumina media at a distance of about 10 cm, rinsed in ethanol and then ultrasonically cleaned in ethanol and air dried at room temperature. The samples were subsequently etched for about 30 min in 5% nitric acid ($HNO_3$) at room temperature. Following the etching, samples were rinsed in deionized water and submerged in suitable neutralizing solution, rinsed and then ultrasonically cleaned in ethanol and air dried at room temperature.

The textured surfaces of the dry samples were then subjected again to the very same contact angle measurement described above.

Fine-grained Ni, Co and Co—P coupons were procured from Integran Technologies Inc. (www.integran.com; Toronto, Canada), the assignee of the present application. Coarse-grained Ni and Co were procured from McMaster-Carr (Aurora, Ohio, USA) in the form of cold rolled & annealed metal sheet. Fine-grained metal matrix coupons and amorphous coupons were electroformed as described in U.S. Patent Publication No. 2005/0205425, also available from Integran Technologies Inc.

The contact angle measurements and the increase in contact angle for textured surfaces are displayed in Table 1. The data illustrates a dramatic difference in contact angles depending on the microstructure of the metallic material with fine-grained metallic material surprisingly experiencing a significant increase in contact angle when suitably shot-peened and etched. The equivalent coarse-grained materials of the same chemistry do not display a commensurate rise in contact angle.

FIGS. 1 through 4 illustrate water droplets on various metallic surfaces and magnified images of the metal surface topography. Specifically FIG. 1*a* illustrates a water droplet on patterned coarse-grained Ni with a contact angle of 91° whereas FIG. 1*b* depicts the SEM image of the patterned coarse-grained Ni surface. FIG. 2*a* illustrates a water droplet on patterned fine-grained Ni with a contact angle of 144° whereas FIG. 2*b* depicts the SEM image of the patterned fine-grained Ni surface with a contact angle of 144°. FIG. 3*a* illustrates a water droplet on a patterned fine-grained Co—$Al_2O_3$-graphite surface with a contact angle of 148° whereas FIG. 3*b* depicts the SEM image of the patterned fine-grained-Co—$Al_2O_3$-graphite metal matrix composite surface. FIG. 4*a* illustrates a water droplet on a patterned amorphous Co-9P surface with a contact angle of 109° whereas FIG. 4*b* depicts the SEM image of the patterned amorphous Co-9P surface.

The majority of the fine-grained and amorphous samples showed a high adhesive force between the water droplet and the patterned surface, similar to the behavior observed with rose petals, whereas others, including the fine-grained Co metal matrix composites exhibited the lotus leaf effect allowing the water to roll off at a low tilt angle.

TABLE 1

Contact angle for various flat and textured metallic surfaces of various compositions and microstructures.

| | Contact angle on smooth metal surface [degrees] | Contact angle on patterned metal surface [degrees] | Contact Angle change [degrees] |
|---|---|---|---|
| Prior art coarse-grained Ni (average grain size 30 microns) | 86 | 91 | +5 |
| Fine-grained Ni (average grain size 15 nm) | 85 | 144 | +59 |
| Fine-grained Ni—20Fe (average grain size 15 nm) | 65 | 101 | +36 |
| Fine-grained Ni—50Fe (average grain size 15 nm) | 70 | 96 | +36 |
| Prior art coarse-grained Co (average grain size 15 micron) | 89 | 87 | −2 |
| Fine-grained Co (average grain size 15 nm) | 68 | 144 | +76 |
| Fine-grained Co—2P (average grain size 15 nm) | 83 | 148 | +65 |

TABLE 1-continued

Contact angle for various flat and textured metallic surfaces of various compositions and microstructures.

| | Contact angle on smooth metal surface [degrees] | Contact angle on patterned metal surface [degrees] | Contact Angle change [degrees] |
|---|---|---|---|
| Fine-grained heat treated at 350° C. for 5 hrs Co—2P (average grain size 15 nm) | 86 | 123 | +37 |
| Fine-grained Co—$Al_2O_3$-graphite Metal-Matrix-Composite (average grain size 15 nm) | 62 | 148 | +76 |
| Amorphous Co—9P | 85 | 132 | +47 |

WORKING EXAMPLE II

Comparison of Contact Angle on Coarse-Grained, Fine-Grained and Amorphous Metallic Surfaces Processed According to the Invention In this example, coupons, 10×10 cm in size and about 1 cm thick, were cut from commercially available conductive carbon-fiber reinforced plastic (CFRP) sheets (HTM 512, available from the Advanced Composites Group Ltd. of Eleanor, Derbyshire, United Kingdom), as used in blades for windmill power generators. The initial substrate preparation procedure was as follows:

(i) mechanically abrading all exposed surfaces using 320 grit to a uniform finish, (ii) scrubbing with steel wool and Alconox cleaner (a surfactant available from Alconox Inc. obtainable from Olympic Trading Co. of St. Louis, Mo., USA), followed by a rinse in deionized water, and (iii) rinsing with isopropanol, followed by drying.

Thereafter the composite coupons were activated using an anodically assisted etched procedure described in U.S. Ser. No. 12/476,506, namely an alkaline permanganate solution (60 g/L M-Permanganate P, Product Code No. 79223) available from MacDermid Inc. of Waterbury, Conn., USA. The samples were anodically polarized in the etching solution at 100 mA/cm$^2$ for 5 min at 45° C.

Following the anodically assisted etching, the samples were rinsed in deionized water and submerged in neutralizer solution (M-Neutralize, Product Code No. 79225 also available from MacDermid Inc.) for about 5 minutes at room temperature. After neutralizing, the samples were rinsed with deionized water and metalized using a commercial silvering solution (available from Peacock Laboratories Inc., of Philadelphia, Pa., USA; average grain size 28 nm). Subsequently, the samples were coated with a 100 μm thick layer of fine-grained Ni, coarse-grained Ni and amorphous Co-9P metallic materials according to the disclosure of U.S. Patent Publication No. 2005/0205425.

To ensure a comparable surface texture of all samples their surfaces were initially ground flat up to 2400 grit SiC paper, rinsed in ethanol, ultrasonically cleaned in ethanol and air dried at room temperature. To eliminate any potential contamination no polishing compounds were employed.

The surfaces of the metallic materials were textured employing the same procedures as described in Example I except that texturing was achieved by four different processes, including (i) chemical etching for about 30 min in 5% nitric acid ($HNO_3$) at room temperature, (ii) shot-peening at about 87 psi (10 passes) using 180 grit alumina media at a distance of about 10 cm, (iii) process (i) followed by process (ii) and (iv) process (ii) followed by process (i). The contact angle measurements are displayed in Table 2. The data indicate that the most significant increase in contact angle for both texturing processes is achieved with the fine-grained and/or amorphous materials. Chemical etching was found to notably increase the contact angle of fine-grained Ni, whereas having little effect on coarse-grained Ni and amorphous Ni, Shot-peening lowered the contact angle of the coarse grained sample, while modestly raising the fine-grained and amorphous contact angles. Chemical etching, followed by shot-peening, did not have a significant or beneficial effect on the contact angles, regardless of the microstructure. Shot-peening followed chemical etching, however, raised the contact angle for all samples. The increase in the contact angle on the coarse-grained and amorphous samples was modest, while the increase in contact angle for the fine-grained sample is dramatic. Table 3 further highlights that the most significant increase in contact angle is achieved when the texturing processes includes shot-peening followed by chemical etching of a fine-grained metallic material.

Selected samples were subsequently coated with an organic paint which further increased the contact angle.

TABLE 2

Contact angle for various flat and textured metallic surfaces of various compositions and microstructures.

| | Prior Art: Contact angle on coarse-grained (average grain size: 30 μm) Ni [degrees] | Inventive Sample: Contact angle on fine-grained (average grain size: 15 nm) Ni [degrees] | Inventive Sample: Contact Angle on amorphous Co9P [degrees] |
|---|---|---|---|
| Smooth | 86 | 85 | 85 |
| Chemically Etched | 95 | 109 | 85 |
| Shot-Peened | 70 | 103 | 90 |

TABLE 2-continued

| Contact angle for various flat and textured metallic surfaces of various compositions and microstructures. | | | |
|---|---|---|---|
| | Prior Art: Contact angle on coarse-grained (average grain size: 30 μm) Ni [degrees] | Inventive Sample: Contact angle on fine-grained (average grain size: 15 nm) Ni [degrees] | Inventive Sample: Contact Angle on amorphous Co9P [degrees] |
| Chemically Etched and Shot-Peened | 75 | 75 | 90 |
| Shot-Peened and Chemically Etched | 91 | 144 | 132 |

TABLE 3

| Contact Angle for Fine-Grained Ni Surfaces after Various Surface Treatments. | | |
|---|---|---|
| | Contact angle of fine-grained Ni (average grain size: 15 nm) [degrees] | Contact angle change over flat and smooth surface [degrees] |
| Smooth | 85 | 0 |
| Chemical etched | 109 | 24 |
| Shot Peened | 103 | 18 |
| Chemical Etched and Shot Peened | 75 | −10 |
| Shot-Preening and Chemically Etched | 144 | 59 |

WORKING EXAMPLE III

Comparison of Wear Performance and Contact Angle Retention of Imprinted Polymer Surfaces and Fine-Grained Metal Surfaces Processed According to the Invention In this example, numerous articles are subjected to abrasive wear in many applications such as impellers and housings for water pumps, etc. In such applications, the abrasive environment is usually sand/particle slurry, moving relative to an exposed surface of a part or article. The abrasive wear of components is directly related to the surface properties, such as hardness and/or toughness. Embossed polymers, as described in the prior art, while having superhydrophobic properties, lack the durability required to provide a meaningful service life in numerous applications. To demonstrate the benefit in durability of wetproofed metal surfaces, a set of superhydrophobic ABS coupons prepared using fine-grained embossing dies as described in the copending application entitled "ARTICLES WITH SUPER-HYDROPHOBIC AND/OR SELF-CLEANING SURFACES AND METHOD OF MAKING SAME", U.S. Ser. No. 12/785,662, filed concurrently with the present application, were tested as prepared, another set was suitably metalized and coated with fine-grained Ni to provide a durable metallic outer surface.

Specifically, ten ABS polymer plaques (ABS BDT5510, SABIC Innovative Plastics, Houston, Tex., USA) of size 1.5"×1.5" were imprinted using the fine-grained Ni coupons which were shot peened and chemically etched as described in Working Example II. Five of the imprinted plaques were selected for further processing. The imprinted ABS coupons were etched using sulfochromic acid and after neutralizing, the samples were rinsed with deionized water and metalized using a commercial amorphous electroless Ni-7P coating process available from MacDermid Inc. of Waterbury, Conn., USA and thereafter coated with 50 μm thick fine-grained Ni (average grain size 15 nm) according to the electrodeposition process described in U.S. Patent Publication No. 2005/0205425, available from Integran Technologies Inc. (www.integran.com; Toronto, Canada). The wear testing was performed by exposing the imprinted, bare ABS surfaces and the fine-grained Ni-coated ABS surfaces to a relative movement between the surfaces and an alumina slurry. The plaques were mounted and on to a disk-shaped holder, which was then rotated at 425 rpm for about 30 minutes, in a slurry of water and sand contained in a cylindrical trough. After about 30 minutes, the plaques were removed from the holder and subjected to ultrasonic cleaning and air-drying, thereafter the weight and contact angle changes recorded. Table 4 shows that the bare, imprinted ABS plaques lose almost twice as much material as the fine-grained Ni coated and imprinted ABS plaques. Furthermore, the contact angle of the bare imprinted ABS drops by more than 16° after sand slurry wear testing, whereas the fine-grained Ni coated imprinted ABS contact angle showed a contact angle drop of less than 3° under the same wear conditions. It is thus clear that the fine-grained Ni coating on the ABS plaques not only helps reduce wear erosion but also maintains the patterning on the outer surface.

TABLE 4

| Wear Test Results | | | | |
|---|---|---|---|---|
| Sample | Weight loss after wear test [mg] | Relative Weight Loss Comparison [%] | Contact angle Drop after wear test [deg] | Relative Contact Angle Loss Comparison [%] |
| Bare, imprinted ABS | 3.94 | 100 | 16.3 | 100 |
| nNi coated, imprinted ABS | 2.10 | 53 | 2.6 | 16 |

With reference to FIG. 5, a schematic illustration of an exemplary article 10 according to the present disclosure is provided. As set forth above, the article 10 includes a surface 12 having a metallic material 20 provided on at least a portion of the article surface such that the metallic material forms at least a part of an exposed surface of the article. The metallic material 20 has one of a microstructure which is fine-grained with an average grain size between 2 nm and 5,000 nm and/or an amorphous microstructure. The metallic material has at least an exposed surface portion having surface structures 30 incorporated therein. In the depicted exemplary article 10, the metallic material includes an exposed surface 22 having a first surface portion 24 and a second surface portion 26. As shown, the first surface portion is generally smooth. The second surface portion is embedded and overlaid with the surface structures 30. As indicated previously, the surface structures can take the shape of elevations, recesses, pits, crevices, depressions and the like in the second surface portion 26. As such, the first and second surface portions 24, 26 remain of the same composition. As shown, the second surface portion 26 has surface structures which include both depressions 32 and elevations 34. The metallic material 20 has an inherent contact angle for water at room temperature of less than 90 degrees when measured on the first surface portion 24. The surface structures 30 incorporated in the second surface portion 26 increase the contact angle for water at room temperature to over 90 degrees. Thus, the exposed surface 22 of the metallic material 20 is formed into a dual surface structure thereby rendering the inherently hydrophilic metallic material hydrophobic without modifying the exposed surface with additional hydrophobic materials. It should be appreciated that the depicted metallic material is by way of example only. As indicated previously, the structured section of the metallic material can extend over between 1% and 100% of the total fine-grained and/or amorphous exposed metallic material surface.

The foregoing description of the invention has been presented describing certain operable and preferred embodiments. It is not intended that the invention should be so limited since variations and modifications thereof will be obvious to those skilled in the art, all of which are within the spirit and scope of the invention.

The invention claimed is:

1. An article comprising:

a metallic material including a metallic layer having a thickness of at least 10 microns positioned on the article and having a microstructure which is fine-grained with an average grain size between 2 nm and 5,000 nm, the metallic layer forming at least a part of an exposed surface of the article;

said metallic layer of said metallic material having at least an exposed patterned surface portion having surface structures having a width of at least 5 microns and a height of between at least 5 microns to about 100 microns incorporated directly therein to increase the contact angle for water at room temperature to over 100 degrees, said metallic layer having an inherent contact angle for water at room temperature of less than 90 degrees when measured on a smooth exposed surface portion of said metallic layer which has a maximum surface roughness Ra of 0.25 microns, wherein the exposed surface of said inherently hydrophilic metallic layer is rendered hydrophobic without the addition of additional hydrophobic materials or coatings applied to the exposed surface.

2. The article according to claim 1, wherein the contact angle of said metallic layer having the exposed surface structures is increased to over 105 degrees.

3. The article according to claim 1, wherein the contact angle of said metallic layer having the exposed surface structures is increased to over 110 degrees.

4. The article according to claim 1, wherein the surface structures of said exposed patterned surface portion of said metallic layer contain macro-surface structures having a height of at least 5 micron, the macro-surface structures being overlaid with nanostructured features having a maximum height of 100 nm, the macro-surface structures being selected from the group consisting of elevations, depressions, recesses, pits, crevices, cavities, pits, pitted surface structures; grooved, roughened and etched surface structures.

5. The article according to claim 4, wherein the macro-surface structures have a population in the range of 5 to 1,000 per mm, said surface structures having a depth, diameter and spacing range of each between 5 μm and 100 μm.

6. The article according to claim 1, wherein said metallic material is selected from the group consisting of:

(i) one or more metals selected from the group consisting of Ag, Al, Au, Co, Cr, Cu, Fe, Ni, Mo, Pd, Pt, Rh, Ru, Sn, Ti W, Zn and Zr, (ii) pure metals or alloys containing at least two of the metals listed in (i), further containing at least one element selected from the group of B, C, H, O, P and S; and (iii) any of (i) or (ii) where said metallic coating also contains particulate additions in the volume fraction between 0% and 95% by volume.

7. The article according to claim 6, wherein the metallic material contains particulate addition and said particulate addition is of one or more materials which is:

(i) a metal selected from the group consisting of Ag, Al, Cu, In, Mg, Si, Sn, Pt, Ti, V, W, Zr, Zn;

(ii) a metal oxide selected from the group consisting of $Ag_2O$, $Al_2O_3$, $SiO_2$, $SnO_2$, $TiO_2$, ZnO;

(iii) a carbide selected from the group consisting of B, Cr, Bi, Si, W;

(iv) carbon selected from the group consisting of carbon nanotubes, diamond, graphite, graphite fibers; ceramic, glass; and (v) a polymeric material selected from the group consisting of PTFE, PVC, PE, PP, ABS, epoxy resin.

8. The article according to claim 1, wherein the exposed surface of said metallic layer is rendered hydrophobic without the addition of additional hydrophobic materials or coatings to the exposed surface by suitably forming a dual microstructure on the metallic layer.

9. An article according to of claim 8, wherein the dual microstructure includes nano-surface structures which have a height equal to or less than 100 nm embedded in and overlaid on the exposed surface with existing macro-surface structures which have a height equal to or greater than 5 micron.

10. An article according to claim 1, wherein said article is a component or part selected from the group consisting of:

(i) applications requiring cylindrical or tubular objects;

(ii) medical equipment;

(iii) sporting goods;

(iv) components and housings for electronic equipment;

(v) automotive components;

(vi) industrial/consumer products and parts;

(vii) molds and molding tools and equipment;

(viii) aerospace parts and components;

(ix) military products; and (x) marine parts and components.

11. The article according to claim 1, wherein the macro-surface structures have a density of between 100 and 5,000 per $mm^2$ area.

12. The article according to claim 1, wherein the exposed surface of said metallic article has a wear rate of less than 25 $mm^3$ at a force of about 45N, a speed of about 21 rad/sec for a total of about 200 revolutions in 60 seconds.

13. An article comprising:

an inherently hydrophilic metallic material including an inherently hydrophilic metallic layer having a thickness of at least 10 microns located on at least part of a surface of the article, said metallic layer having an amorphous microstructure, at least an exposed patterned surface portion of said metallic layer is imprinted with surface sites having a height of at least 5 microns to raise the contact angle for deionized water in the imprinted surface portion of said metallic layer by at least 40° at room temperature when compared to a smooth exposed surface of the metallic layer of the same composition as the imprinted surface portion having a maximum surface roughness Ra of 0.25 microns.

14. An article according to of claim 13, wherein the surface sites imprinted in the exposed surface portion comprise both micron-sized features having a height of at least 5 microns and nano-sized features having a height of less than 100 nm.

15. A method for manufacturing an article having a hydrophobic metallic surface layer having a thickness of at least 10 microns covering a surface of the article comprising:

providing a hydrophilic metallic material layer having at least one of a microstructure which is fine-grained with an average grain size between 2 and 5,000 nm and an amorphous microstructure;

incorporating surface structures having a height of at least 5 microns into at least a portion of an exposed surface of said hydrophilic metallic material layer to render said portion of the exposed surface of said metallic material layer hydrophobic and increase the contact angle for deionized water in the exposed surface of said metallic material layer having the structured portions to equal to or greater than 110 degrees at room temperature by treating the hydrophilic metallic material layer by shot-peening followed by etching.

16. The method according to claim 15, further comprising randomly distributing the surface structures in the hydrophobic surface of said metallic material layer, the randomly distributed surface structures containing a plurality of micron-sized features having a minimum height of 5 microns, wherein the plurality of micron-sized features further has a substructure comprising of a plurality of nanoscale features having a maximum height of 100 nm.

17. The method according to claim 15, further comprising modifying the surface of said metallic material layer of the article by applying a top coat.

18. A method according to claim 15, wherein the metallic material layer is deposited onto a permanent or temporary substrate by a process selected from the group consisting of electrodeposition, physical vapor deposition (PVD), and chemical vapor deposition (CVD).

19. A method according to claim 15, wherein the metallic material layer is applied to temporary or permanent substrate having a suitably structured surface to render the conforming metallic material hydrophobic.

20. A method according to claim 15, wherein the metallic material surface layer is treated by at least one process selected from the group consisting of chemical etching, electrochemical etching and plasma etching.

21. The method according to claim 15, wherein said metallic layer comprises at least one element selected from the group consisting of Ni, Co, Fe and P.

* * * * *